US008302709B2

(12) United States Patent
Bhome et al.

(10) Patent No.: US 8,302,709 B2
(45) **Date of Patent: *Nov. 6, 2012**

(54) DOWNHOLE TOOL LEG RETENTION METHODS AND APPARATUS

(75) Inventors: Amol Bhome, Spring, TX (US); Robert H. Slaughter, Jr., Spring, TX (US)

(73) Assignee: Sandvik Intellectual Property AB, Sandviken (SE)

( * ) Notice: Subject to any disclaimer, the term of this patent is extended or adjusted under 35 U.S.C. 154(b) by 509 days.

This patent is subject to a terminal disclaimer.

(21) Appl. No.: 12/489,282

(22) Filed: Jun. 22, 2009

(65) Prior Publication Data

US 2010/0319993 A1 Dec. 23, 2010

(51) Int. Cl.
*E21B 10/633* (2006.01)

(52) U.S. Cl. ..... 175/406; 175/384

(58) Field of Classification Search ..... 175/53, 175/344, 406, 384

See application file for complete search history.

(56) References Cited

U.S. PATENT DOCUMENTS

| | | | | |
|---|---|---|---|---|
| 6,745,858 | B1 | 6/2004 | Estes | |
| 7,152,702 | B1 * | 12/2006 | Bhome et al. | 175/384 |
| 2010/0252326 | A1 * | 10/2010 | Bhome et al. | 175/53 |

* cited by examiner

*Primary Examiner* — William P Neuder
(74) *Attorney, Agent, or Firm* — Osha Liang LLP

(57) ABSTRACT

A back reamer includes a drive stem configured to support a main reamer body, the main reamer body including a plurality of receptacles, and a plurality of cutting leg assemblies in positive locking engagement with the plurality of receptacles to restrict radial movement of the cutting leg assemblies.

29 Claims, 15 Drawing Sheets

DOWNHOLE TOOL LEG RETENTION METHODS AND APPARATUS

BACKGROUND

1. Field of the Disclosure

Embodiments of the present disclosure relate generally to horizontal directional drilling reamers. More particularly, embodiments of the present disclosure relate to methods and apparatus to minimize movement of cutting leg assemblies mounted on directional drilling reamers.

2. Background Art

Horizontal directional drilling ("HDD") is a process through which a subterranean bore is directionally drilled in a substantially horizontal trajectory from one surface location to another. Typically, HDD operations are used by the utilities industry to create subterranean utility conduits underneath pre-existing structures, but any application requiring a substantially horizontal borehole may utilize HDD. Frequently, HDD bores are drilled to traverse rivers, roadways, buildings, or any other structures where a "cut and cover" methodology is cost prohibitive or otherwise inappropriate.

During a typical HDD operation, a horizontal drilling rig drives a drill bit into the earth at the end of a series of threadably connected pipes called a drillstring. As the operation is substantially horizontal, the drilling rig supplies rotational (torque on bit) and axial (weight on bit) forces to the drill bit through the drillstring. As the drill bit proceeds through the formation, additional lengths of drill pipe are added to increase the length of the drillstring. As the drillstring increases in flexibility over longer lengths, the drillstring can be biased in a predetermined direction to direct the path of the attached drill bit. Thus, the drilling is "directional" in that the path of the bit at the end of the drillstring can be modified to follow a particular trajectory or to avoid subterranean obstacles.

Typically, HDD operations begin with the drilling of a small "pilot" hole from the first surface location using techniques described above. Because of the diminished size in relation to the final desired diameter of the borehole, it is much easier to directionally drill a pilot bore than a full-gage hole. Furthermore, the reduced size of the pilot bit allows for easier changes in trajectory than would be possible using a full-gage bit. At the end of the pilot bore, the drillstring emerges from the second surface location, where the pilot bit is removed and a back reamer assembly is installed. Usually, the back reamer assembly is a stabilized hole opener that is rotated as it is axially pulled back through the pilot bore from the second surface location to the first surface location. The drilling rig that supplied rotary and axial thrusting forces to the pilot bit during the drilling of the pilot bore supplies rotary and axial tensile forces to the back reamer through the drillstring during the back reaming.

Referring now to FIGS. 1A-1C, side views of cutting leg assemblies 12 mounted on a back reamer are shown indicating loads applied on cutting leg assemblies 12 during operation. During HDD operations, stressing and cracking may occur in retention arrangements (e.g., welds) that secure cutting leg assemblies 12 to receptacles 10 of a main reamer body 6. As shown, normal cutting loads "C" are applied on cutting leg assembly 12 due to contact between cutters on the rotating cutter body 16 and the borehole being drilled. Additionally, dead weight of the entire reamer (some reamers may weight up to 12,000 pounds or more) during each revolution and vibrations during operation combine to form a dynamic load "D," which causes leg movement within the receptacles. Dynamic load D (and resulting stresses) varies from minimum to maximum and again to minimum at least once during one revolution of the reamer as the reamer rotates in the borehole and the cutting leg assembly moves into and out of contact with the borehole.

Dynamic loads D may be typically concentrated in an area where rotating cutter body 16 (cone) attaches to cutter leg 14 because the region where rotating cutter body 16 attaches to cutter leg 14 is closest to the borehole wall (due to protrusion of cutter body 16 in a radial direction). As shown in FIG. 1B, as dynamic loads D are applied, a front edge of the receptacle acts as a fulcrum "F" and a back end of cutting leg assembly 12 is pushed or lifted out of receptacle 10 in a direction generally perpendicular to the reamer axis 1, or radial direction. This movement of cuffing leg assembly 12 inside receptacle 10 causes stressing of retention methods. Cracks are observed in welded reamer at weld locations "W," as shown in FIG. 1C. Stressing and subsequent cracking of the welds may typically start at the back of the cutting leg assembly 12 (end opposite the cutter body 16) and separation of the cutting leg assembly 12 from the receptacle may be highest in this location.

Accordingly, there exists a need for method and apparatus to mitigate weld cracking between reamer bodies and cutting leg assemblies.

SUMMARY OF THE DISCLOSURE

In one aspect, embodiments disclosed herein relate to a back reamer including a drive stem configured to support a main reamer body, the main reamer body including a plurality of receptacles, and a plurality of cutting leg assemblies in positive locking engagement with the plurality of receptacles to restrict radial movement of the cutting leg assemblies.

In other aspects, embodiments disclosed herein relate to a method of securing cutting leg assemblies to a main reamer body of a back reamer, the method including inserting the cutting leg assembly into a corresponding receptacle formed in the main reamer body, positively locking the cutting leg assembly and the corresponding receptacle to restrict radial movement of the cutting leg assembly, and welding the cutting leg assembly to the corresponding receptacle.

In other aspects, embodiments disclosed herein relate to a back reamer including a drive stem configured to support a main reamer body, the main reamer body including a plurality of receptacles, a plurality of cutting leg assemblies in positive locking engagement with the plurality of receptacles to restrict axial movement of the cutting leg assemblies, and a rear protrusion of at least one cutting leg assembly configured to engage a pocket formed in a back wall of the corresponding receptacle, wherein the cutting leg assemblies and the plurality of receptacles are welded along a substantial length of an externally accessible interface between the cutting leg assemblies and the plurality of receptacles.

Other aspects and advantages of the invention will be apparent from the following description and the appended claims.

DETAILED DESCRIPTION

Embodiments disclosed herein relate to a back reamer assembly for use in drilling. In particular, embodiments disclosed herein relate to methods and apparatus providing positive locking engagements between cutting leg assemblies and receptacles of a main reamer body to prevent radial movement of the cutting leg assemblies within the receptacles of the main reamer body.

Figure 2:
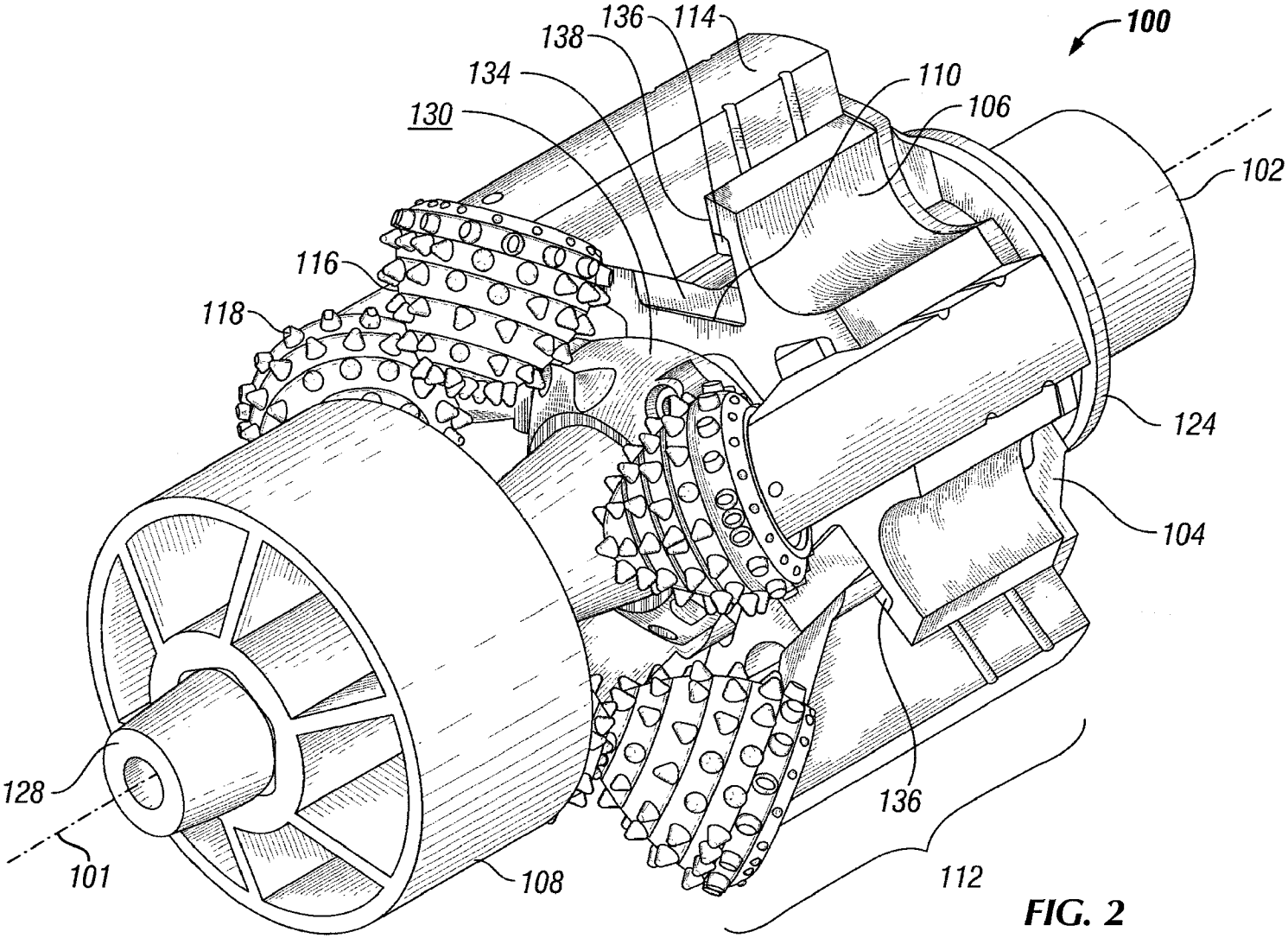
FIG. 2 is a perspective view of a back reamer assembly in accordance with embodiments of the present disclosure.
Figure 3:
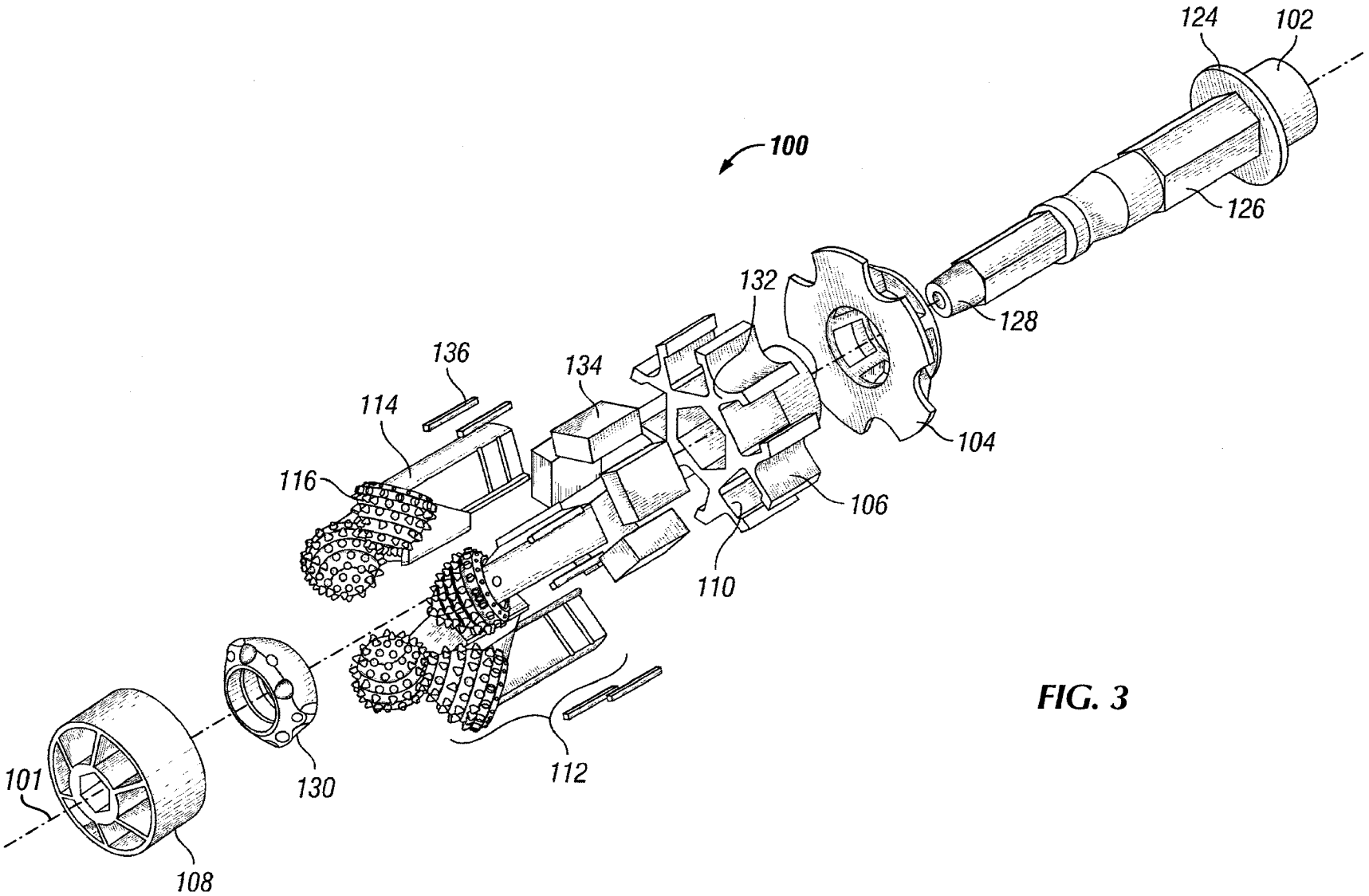
FIG. 3 is an exploded view of the back reamer assembly of FIG. 1.

Referring initially to FIGS. 2 and 3 together, a back reamer assembly 100 is shown. FIG. 2 depicts back reamer assembly 100 in an assembled state and FIG. 3 depicts back reamer assembly 100 in an exploded state. Back reamer 100 has a central axis 101, and as shown, includes a drive stem 102 upon which a support plate 104, a main reamer body 106, and a centralizer 108 are mounted. Main reamer body 106, positioned between support plate 104 and centralizer 108, includes a plurality of receptacles 110, in which a plurality of cutting leg assemblies 112 are mounted. Main reamer body 106 may be a fabricated body, i.e., multiple pieces welded together to form the body, or alternatively, main reamer body 106 may be an integral body formed as a single piece. Alternatively, main reamer body 106 and drive stem 102 may be formed as a one piece integral body.

Figure 4:
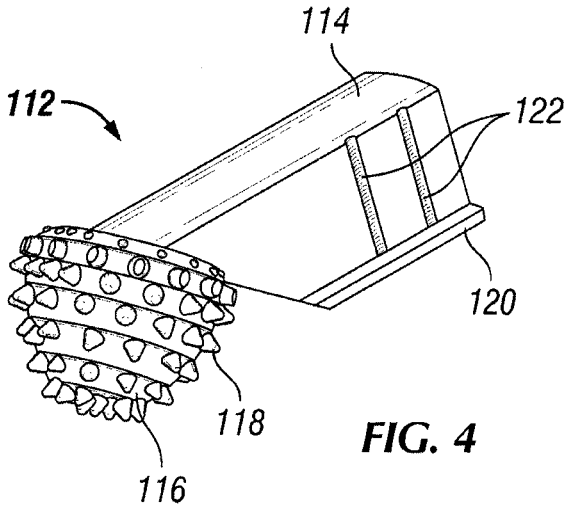
FIG. 4 is a perspective view of a cutting leg assembly of FIG. 1.

Referring briefly to FIG. 4, each cutting leg assembly 112 includes a cutter leg 114 and a rotating cutter body 116. Upon the periphery of each cutter body 116 are a plurality of cutting elements 118. Cutting elements 118 can be of any geometry, design, and material appropriate for the formation to be drilled, but are typically constructed as either tungsten carbide insert ("TCI") elements, hardmetal coated milled tooth elements, or polycrystalline diamond compact cutters (or other drag type cutting elements). While cutter body 116 is shown constructed as a cone-shaped roller cone similar to those used in vertical drilling applications, it should be understood that various designs and geometries for cutter body 116 can be used. Cutter leg 114 includes an upset ridge 120 on either side thereof. As will be described in further detail below, upset ridges 120 are constructed to prevent cutting leg assemblies 112 from being removed from their positions within receptacles 110 of main body 106 of FIGS. 2 and 3. Furthermore, cutter leg 114 includes a pair of cylindrical slots 122 of FIG. 4 on either side of cutter leg 114 for the insertion of taper pins (not shown) to prevent lateral (i.e., side-to-side or tangential) movement of cutter leg 114 in reaction to drilling forces. Taper pins (not shown) or any other retention method (mechanical fastening or metallurgical joint) may prevent dislodging of cutter legs 114 from receptacles 110 in an axial direction.

Referring back to FIGS. 2 and 3 together, back reamer assembly 100 is constructed from a plurality of components secured upon drive stem 102. Drive stem 102 is shown having a load flange 124 at its distal end, a polygonal profile 126 along its length, and a threaded rotary drillstring connection 128 at its proximal end. As back reamer 100 is typically pulled through a pilot bore as it cuts, load flange 124 transmits axial forces to cutting assemblies 112 while polygonal profile 126 transfers rotational forces to cutting assemblies 112. Support plate 104 acts to transmit axial loads between main body 106 and load flange 124 of drive stem 102. Main body 106 functions to retain cutting assemblies 112 and transmit drilling forces thereto. Rotational forces are transferred from polygonal profile 126 of drive stem 102 to cutting assemblies 112 through a corresponding polygonal profile 132 of main body 106. Centralizer 108 functions to guide back reamer assembly 100 and maintain trajectory along the path of a pre-drilled pilot bore. Hydraulic hub 130 functions to direct cutting fluids from the bore of the drillstring (including a bore of drive stem 102) to cutting elements 118 of cutter bodies 116. Those having ordinary skill will appreciate that the polygonal profile 120 is used as a matter of convenience and that other geometries may be used.

In certain embodiments, components of back reamer assembly 100 may be described as "modular" components in that, depending on the particularities of the job to be drilled, the components can be swapped out or reconfigured to accommodate a variety of gauge sizes or geometries. Particularly, cutting leg assemblies 112 are configured to be retained within receptacles 110 of main body 106 at varying radial heights. Therefore, a combination of one set of cutting leg assemblies 112 with a single main body 106 can be configured to drill a range of borehole diameters. If a diameter outside the range is desired to be cut, either the cutting leg assemblies 112, the main body 106, or both may be replaced with a smaller or larger size cutting leg assemblies 112. Similarly, different sized centralizers 108 can be used with back reamer assembly 100 if the size of the pilot bore to be followed changes. Furthermore, a modular construction of back reamer assembly 100 may allow for different geometry cutting leg assemblies 112 to be used. FIGS. 2-4 disclose cutting leg assemblies 112 having roller cone cutter bodies 116, but it should be understood that different cutter configurations, including scraping cutters, can be used in conjunction with main body 106. In other embodiments, the reamer may be characterized as a non-modular reamer in that the components are designed specifically for drilling a particular wellbore and are not interchangeable.

Still referring to FIGS. 2 and 3, a plurality of shims 134, 136 may be used in conjunction with receptacles 110 of main body 106 to retain cutting leg assemblies 112 in radial position. Shims 134 are base shims positioned underneath cutter legs 114 between cutting leg assemblies 112 and receptacles 110 of main body 106. Base shims 134 prevent cutting leg assemblies 112 from retracting radially within receptacles 110. Upper shims 136 are positioned above upset ridges (120 of FIG. 4) on either side of cutter legs 114 between ridges (120 of FIG. 4) and receptacles 110. As can be seen, receptacles 110 include retainers 138 at their radial limits to prevent cutting leg assemblies 112 from dislodging therefrom. Desirably, retainers 138 are dimensioned so as to allow the clearance of cutter legs 114 but not upset ridges 120. When installed within receptacles 110, upper shims 136 act as extensions of upset ridges 120, thereby preventing cutting leg assemblies from extending outward radially.

To retain cutting leg assemblies 112 at a desired height corresponding to a particular drilling diameter, base shims 134 and upper shims 136 may be selected and installed to ensure the cutting leg assemblies 112 are securely retained at a specific height. Thus, in typical applications, the minimum diameter for any particular cutting leg 112 and main body 106 include the thinnest shims 134 (or no shims at all) at the base of receptacle 110 in conjunction with the thickest shims 136 disposed at the top of receptacle 110. Conversely, the maximum diameter would include the thickest shims 134 at the base of receptacle 110 and the thinnest shims 136 (or no shims at all) at the top of receptacle 110. Again, such an arrangement is not required, but is a matter of convenience.

Figure 1A:
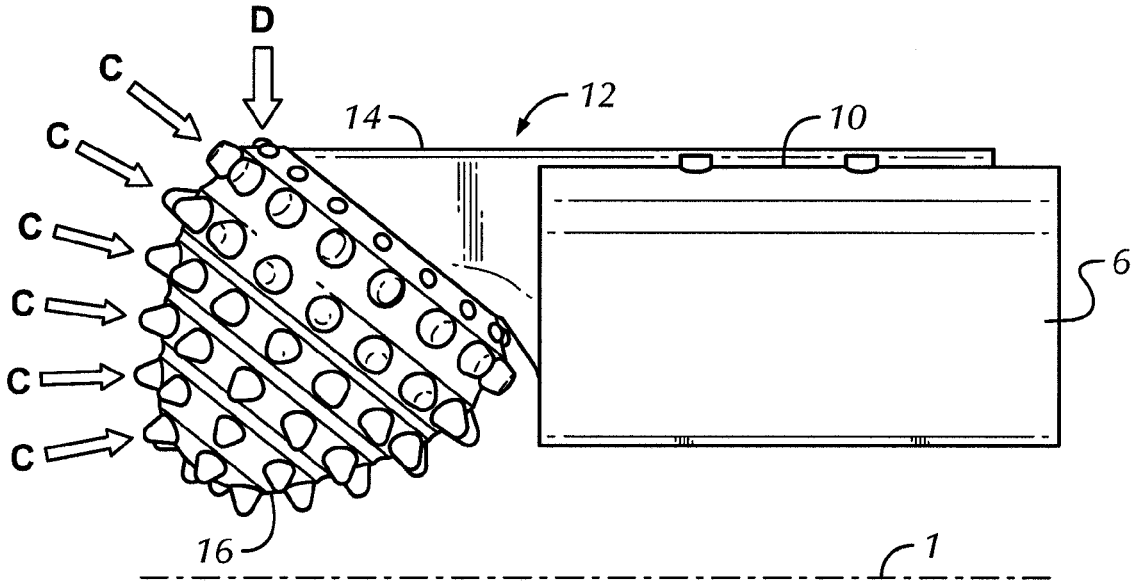
FIG. 1A (Prior Art)
FIGS. 1A-1C are side views of conventional cutting leg assemblies that show loads applied on the cutting leg assemblies during operation.
Figure 1B:
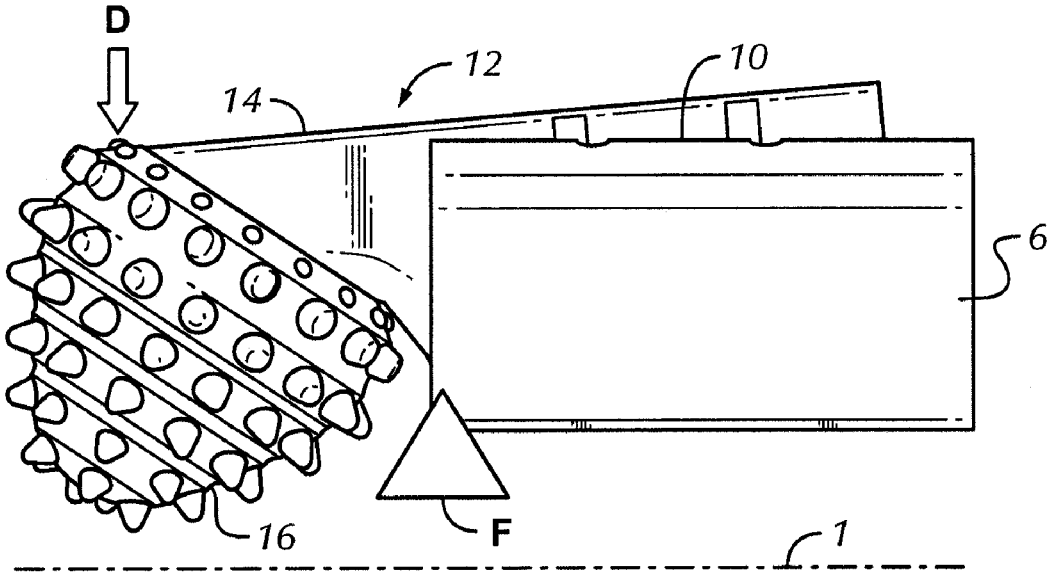
FIG. 1B (Prior Art)
Figure 1C:
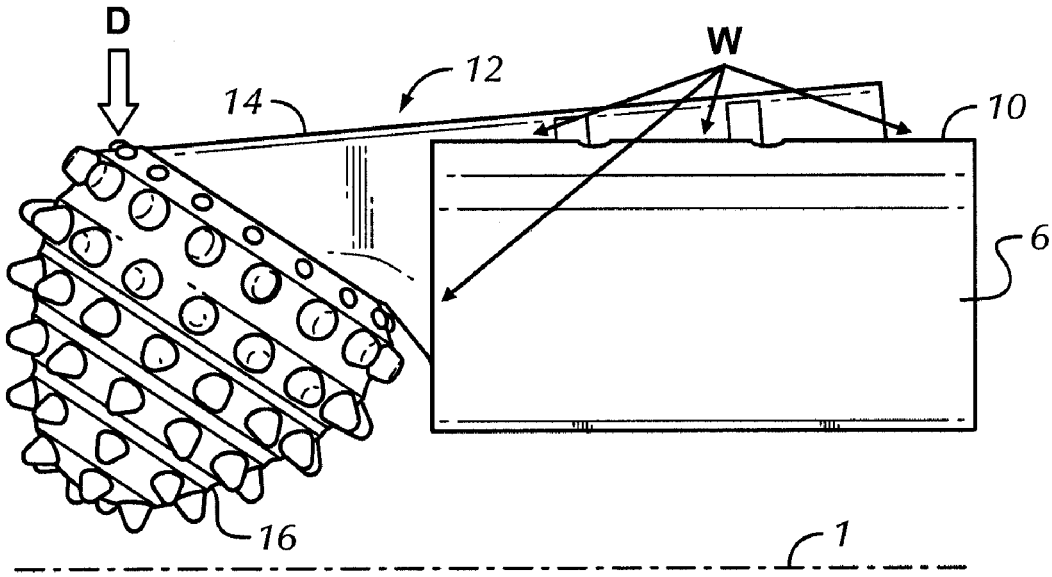
FIG. 1C (Prior Art)
Figure 5A:
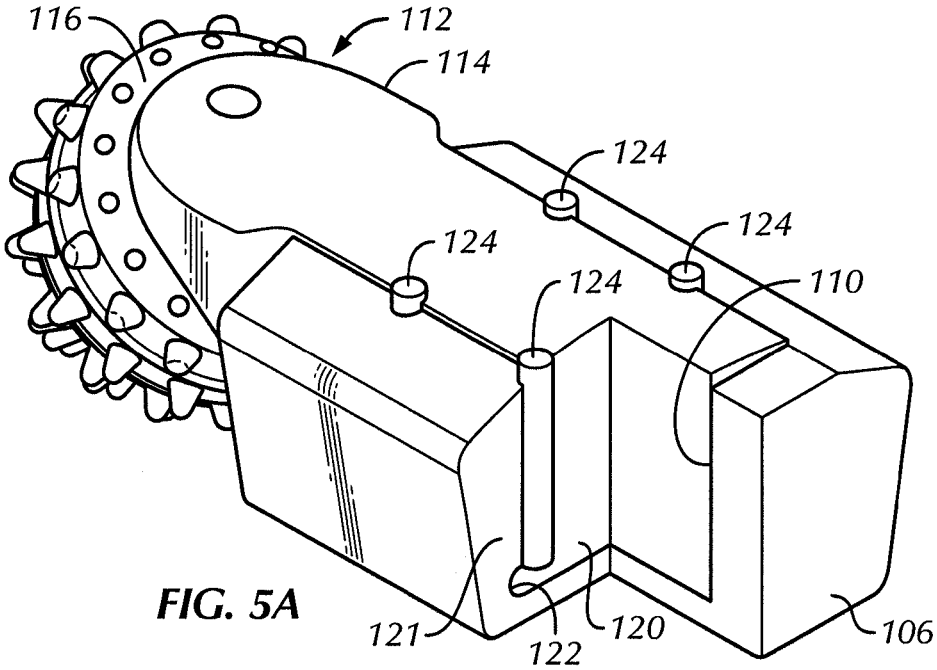
FIGS. 5A and 5B show cut-away perspective and end views, respectively, of a cutting leg assembly having a lip section in accordance with embodiments of the present disclosure.
Figure 5B:
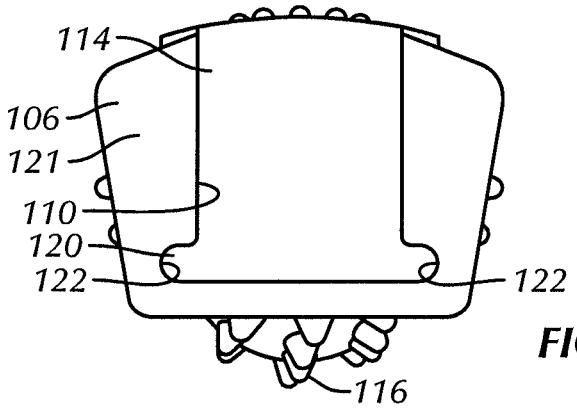
Figure 6A:
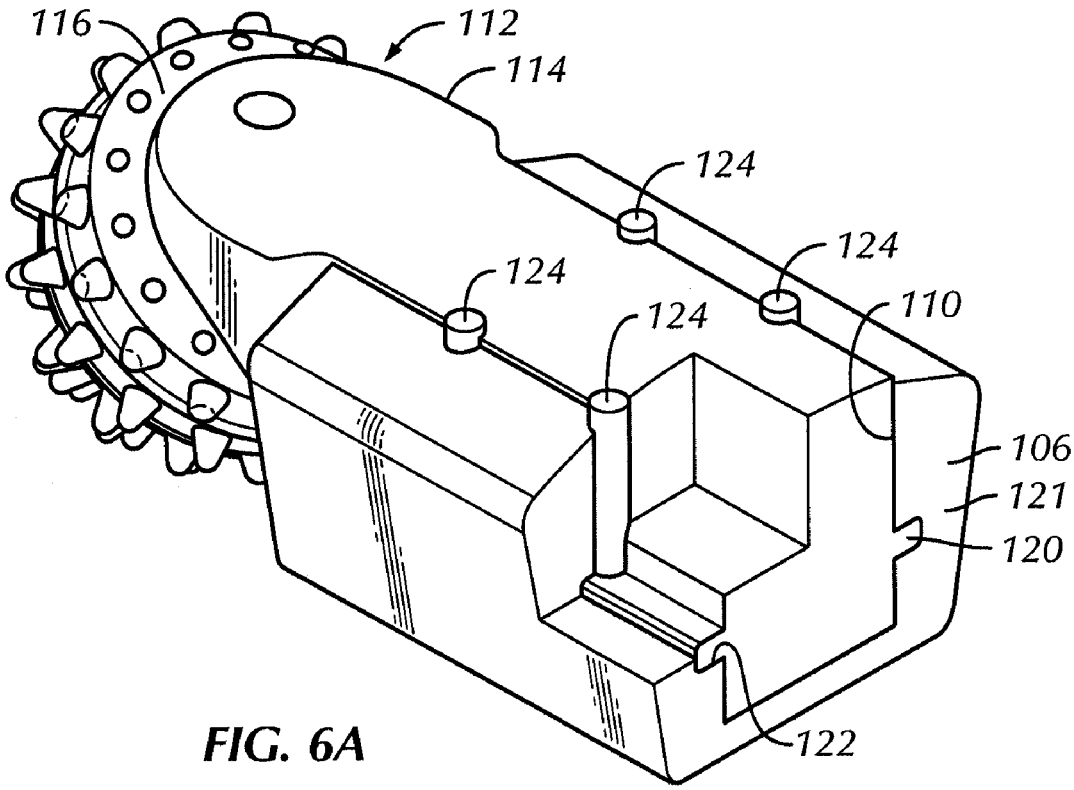
FIGS. 6A and 6B show cut-away perspective and end views, respectively, of a cutting leg assembly having a variation of the lip section shown in FIGS. 5A and 5B.
Figure 6B:
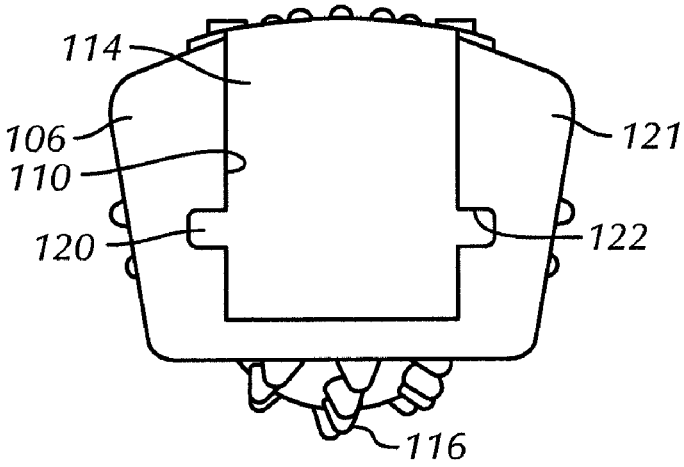

Referring now to FIGS. 5A and 5B, cut-away perspective and end views, respectively, of a cutting leg assembly 112 having a lip section 120 are shown in accordance with embodiments of the present disclosure. Cutter leg 114 includes a positive locking arrangement, a lip section 120, which may be shaped like an inverted letter "T" (as viewed in cross-section, shown in FIG. 5B). Lip section 120 engages a corresponding inverted "T" cutout 122 inside receptacle 110. Lip section 120 may run along a full or partial length (along the reamer axis 101 of FIG. 1) of cutter leg 114 and/or receptacle 110. In certain embodiments, lip portion 120 of cutting leg 114 may be formed integral with cutting leg 114. In other embodiments, lip portion 120 may be mechanically or metallurgically attached to cutter leg 114. Further, in certain embodiments, a portion 121 above lip cutouts 122 in receptacle 110, as shown in the figures, may be mechanically or metallurgically attached to receptacle. After cutter leg 114 is inserted into receptacle 110, taper pins 124, as shown in FIG. 5A, may be inserted in a direction perpendicular to the central reamer axis to prevent the cutting leg assembly 112 from moving in an axial direction out of receptacle 110. Taper pins 124 may be secured to reamer body 106 mechanically or metallurgically. In alternative embodiments, cutting leg assembly 112 may be secured to reamer body mechanically or metallurgically and without taper pins 124. FIGS. 6A and 6B show cut-away perspective and end views, respectively, of a cutting leg assembly 112 having a variation of the lip section 120 shown in FIGS. 5A and 5B. Rather than being located at a bottom of the cutter leg 114, lip section 120 is located further up, as shown. Lip section 120 may be located at any distance from a bottom of cutter leg 114. Lip section 120 may have any cross sectional geometry, such as but not limited to rectangular, trapezoidal, triangular, semi-circular, or dovetail.

Figure 7A:
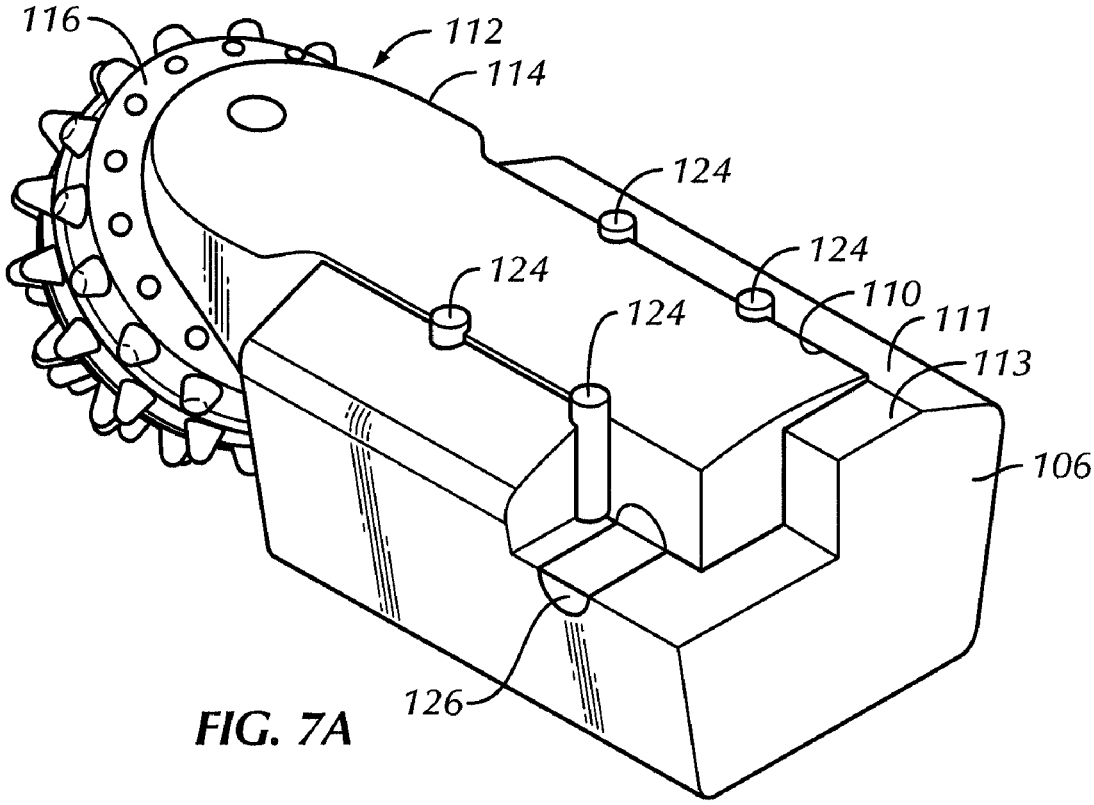
FIGS. 7A and 7B show cut-away perspective and end views, respectively, of a cutting leg assembly having side pins in accordance with embodiments of the present disclosure.
Figure 7B:
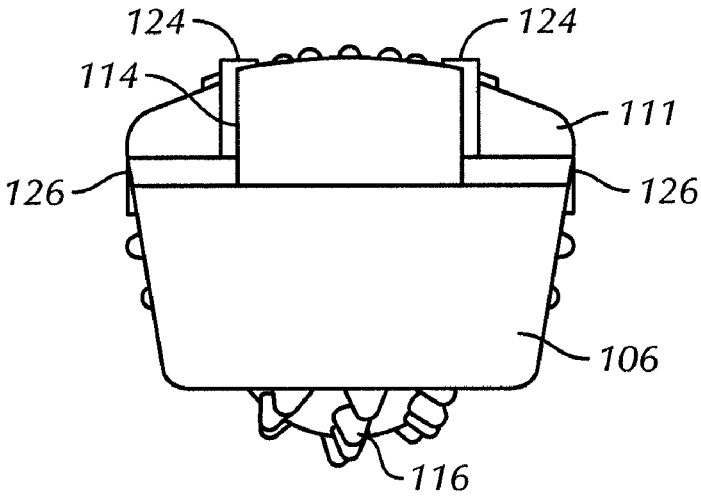

Referring now to FIGS. 7A and 7B, cut-away perspective and end views, respectively, of a cutting leg assembly 112 having side pins 126 are shown in accordance with embodiments of the present disclosure. After cutting leg assembly 112 is inserted into receptacle 110, at least one side pin 126 is inserted through a side wall 111 of receptacle 110 to engage a corresponding feature (e.g., a hole of matching, or larger, or smaller diameter, as pin 126) in a side wall of cutter leg 114. To provide the most robust retention of cutting leg assembly 112, side pin 126 may be inserted closest to a back wall 113 (wall opposite cutter body 116) of receptacle 110. In certain embodiments, the corresponding feature with which side pin 126 engages may be an inverted T-lip (as shown in FIGS. 5 and 6) or any other features to lock in a radial direction (perpendicular to reamer central axis 101). Also, taper pins 124 may be inserted in a direction perpendicular to the central reamer axis to prevent the cutting leg assembly 112 from moving in an axial direction out of receptacle 110. Side pin 126 may be replaced by other mechanical fasteners, including but not limited to, threaded fasteners, cotter pins, and taper pins. Additionally, side pin 126 may be mechanically or metallurgically attached to receptacle 110 and/or cutter leg 114 and/or reamer body 106, or side pin 126 may be made integral with receptacle 110 or cutter leg 114. One or multiple side pins 126 may be used and applied from either or both sides of cutter leg assembly 112. In alternative embodiments, a single pin 126 may be through one side wall of receptacle 110, pass through cutter leg 114, and emerge out from a second side of receptacle 110. In further alternative embodiments, a single pin 126 may pass through one side wall of receptacle 110, pass through cutter leg 114, and engage any feature (e.g., hole, T-lip) on a second side of receptacle 110. Alternatively, side pin 126 may be partially captured inside a blind hole in cutter leg 114 and partially captured inside a blind hole in receptacle 110.

Figure 8A:
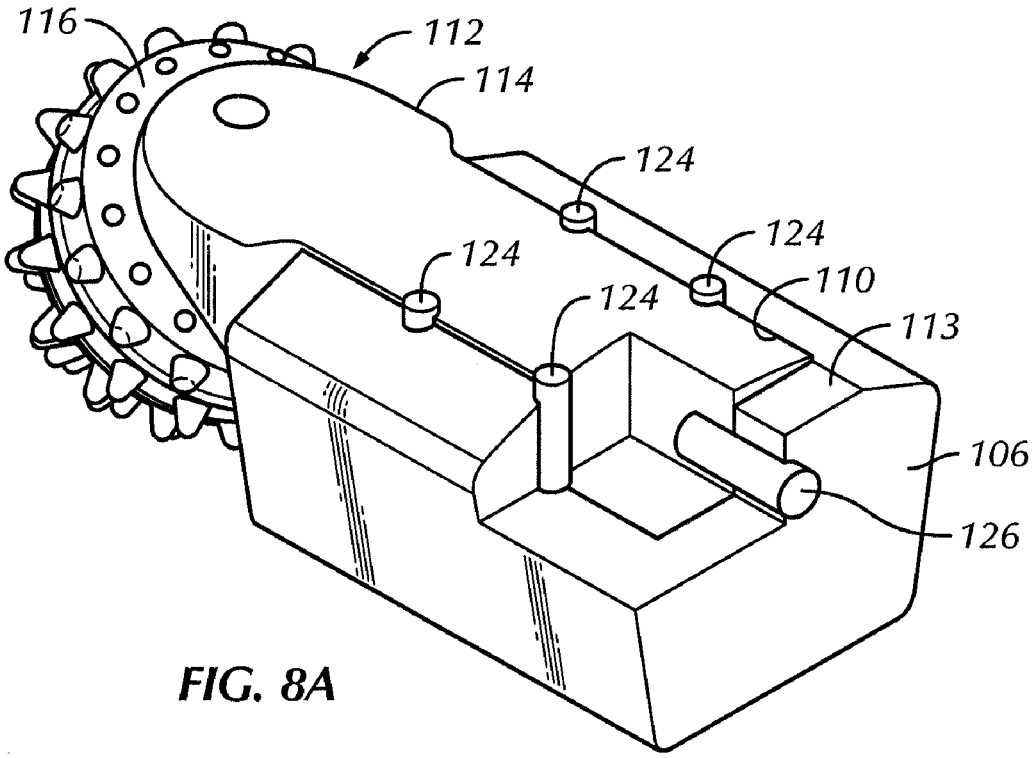
FIGS. 8A-8F show cut-away perspective views of a cutting leg assembly having a back pin in accordance with embodiments of the present disclosure.

Now referring to FIG. 8A, a cut-away perspective view of a cutting leg assembly 112 having a back pin 126 in accordance with embodiments of the present disclosure is shown. After cutting leg assembly 112 is inserted into receptacle 110, at least one back pin 126 is inserted through a back wall 113 of receptacle 110 to engage a corresponding feature (e.g., a hole of matching or larger diameter as pin 126) in back wall of cutter leg 114. Also, taper pins 124 may be inserted in a direction perpendicular to the central reamer axis to prevent the cutting leg assembly 112 from moving in an axial direction out of receptacle 110. Back pin 126 may be replaced by other mechanical fasteners, including but not limited to, threaded fasteners, cotter pins, and taper pins. Additionally, back pin 126 may be mechanically or metallurgically attached to receptacle 110 and/or cutter leg 114 and/or reamer body 106. Alternatively, back pin 126 may be partially captured inside a blind hole in cutter leg 114 and partially captured inside a blind hole in receptacle 110 or reamer body 106.

Figure 8B:
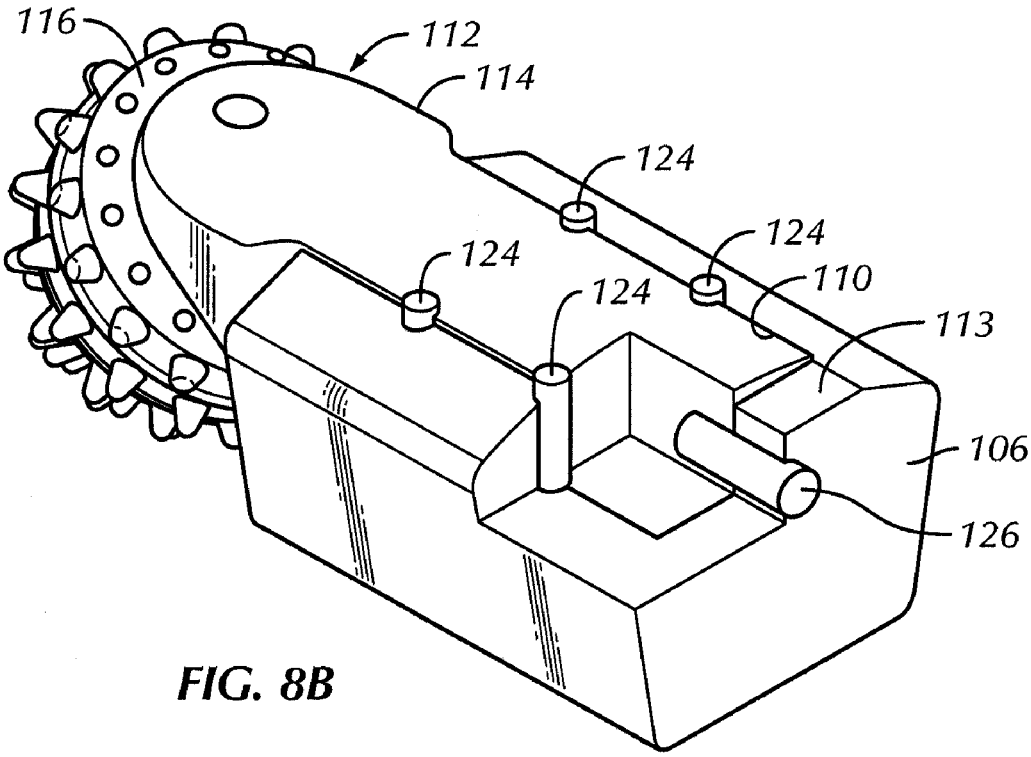
Figure 8C:
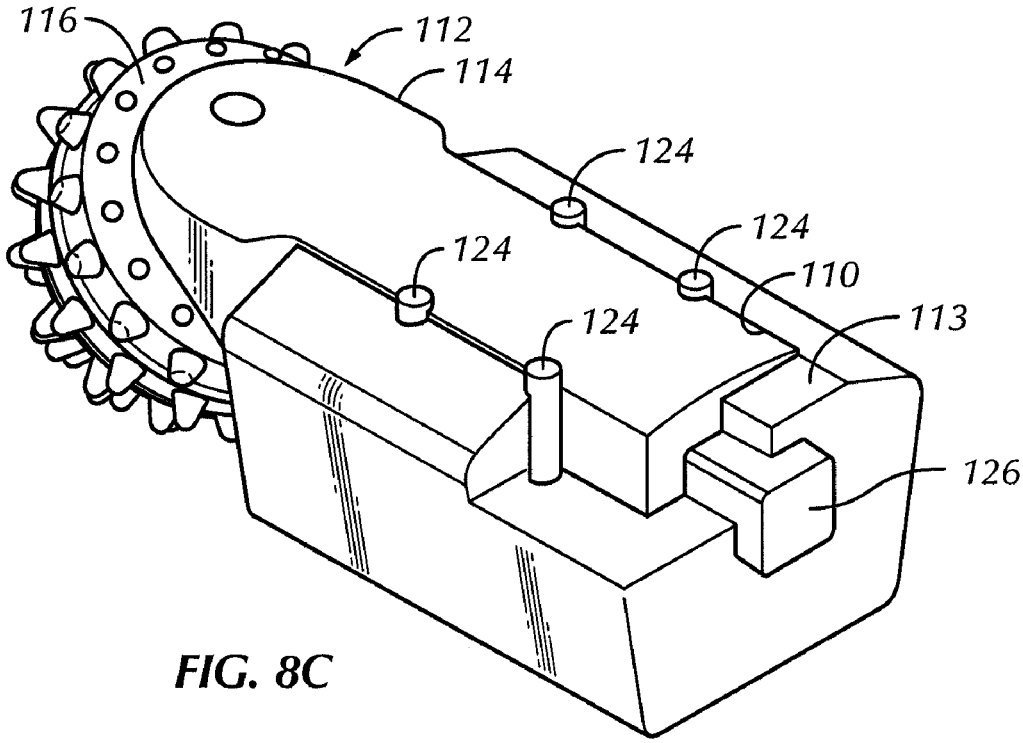
Figure 8D:
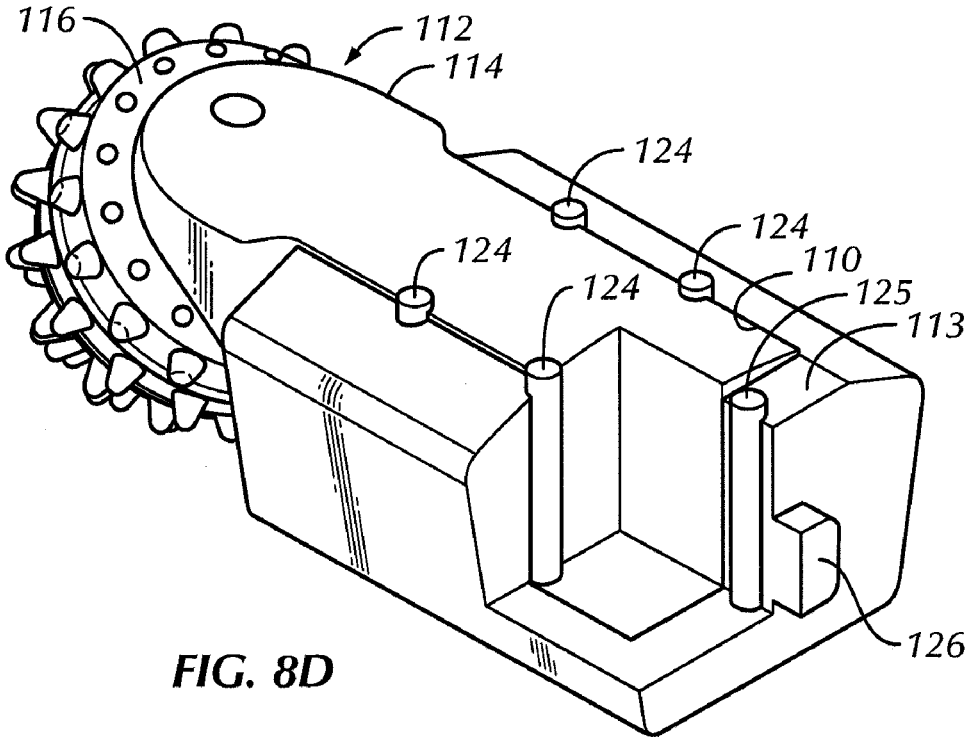
Figure 8E:
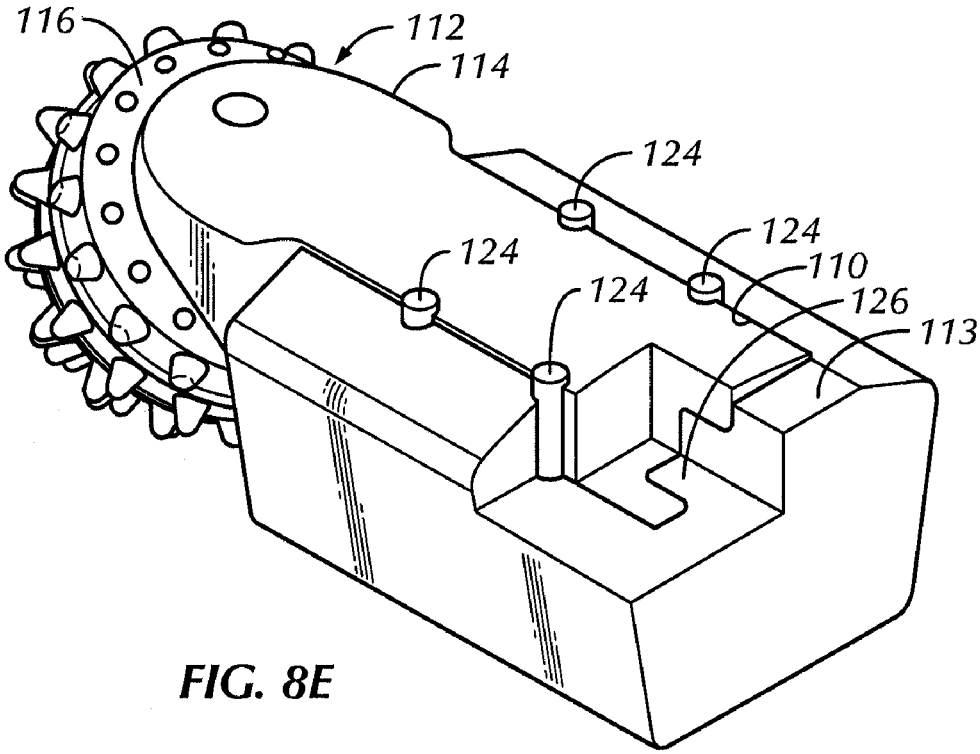
Figure 8F:
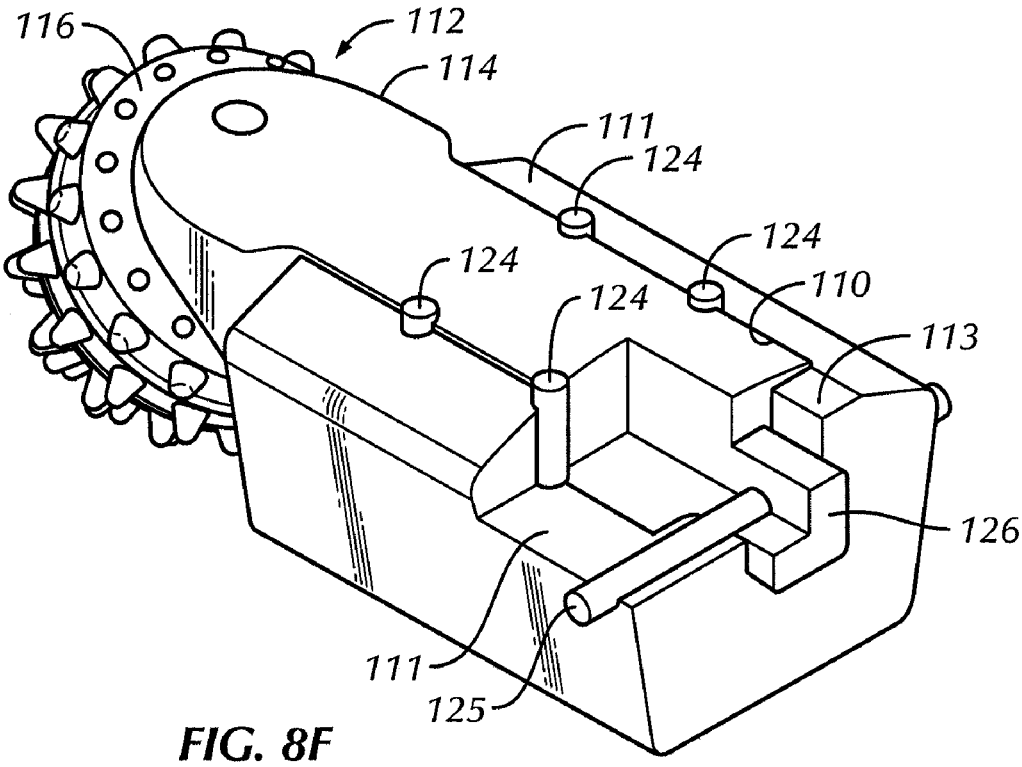

FIGS. 8B-8F show cut-away perspective views of alternative embodiments similar to FIG. 8A. FIG. 8B shows a pin 126 inserted through a back wall 113 of receptacle 110 to engage a corresponding hole in back of cutter leg 114. FIG. 8C shows a protrusion 126 integral with cutter leg 114 that engages a slot in a back wall 113 of receptacle 110. FIG. 8D shows a protrusion 126 integral with cutter leg 114 that engages a slot in a back wall 113 of receptacle 110 and further includes a pin 125 inserted in a radial direction through protrusion 126 to engage a bottom wall of receptacle 110. FIG. 8E shows a protrusion 126 integral with a back wall 113 of receptacle 110 that engages a pocket formed in a back wall of cutter leg 114, as shown. FIG. 8F shows a protrusion 126 integral with a cutter leg 114 that engages a slot in a back wall of receptacle 110, and further includes a cross pin 125 inserted through side walls 111 of receptacle 110. In certain alternative embodiments, back pin 126 may be captured inside a blind hole located in a back wall of cutter leg 114 and a blind hole in a back wall of receptacle 110. In further alternative embodiments, back pin 126 may be configured as an integral protrusion on cutter leg 114, which is inserted into a blind hole in the back wall of receptacle 110. Still further, any combination of side pins (shown in FIG. 7) and back pins may be used in accordance with embodiments of the present disclosure.

Figure 9A:
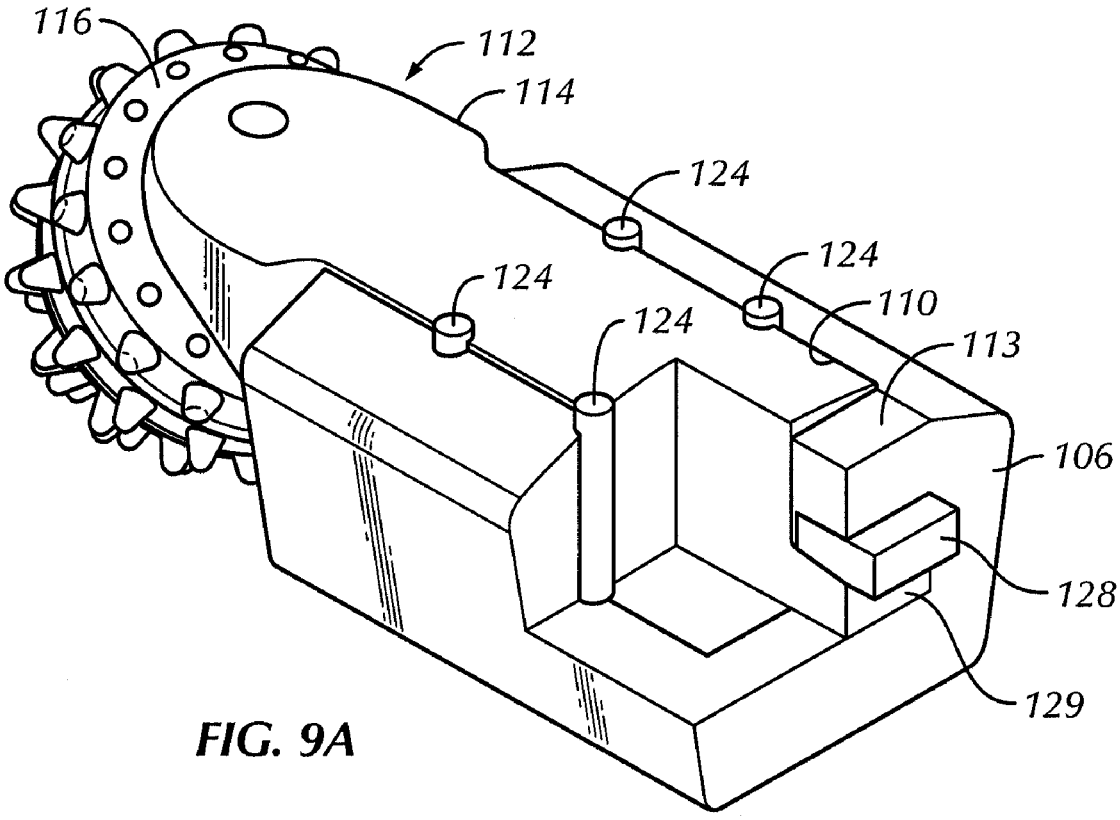
FIGS. 9A and 9B show cut-away perspective and cross-sectional views, respectively, of a cutting leg assembly having a back wedge in accordance with embodiments of the present disclosure.
Figure 9B:
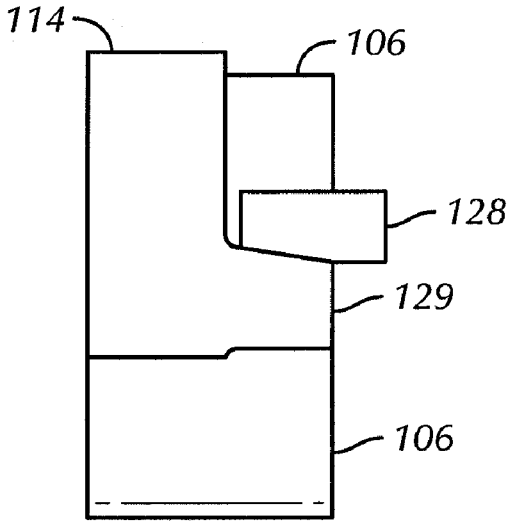

Referring now to FIGS. 9A and 9B, cut-away perspective and cross-sectional views, respectively, of a cutting leg assembly 112 having a back wedge 128 in accordance with embodiments of the present disclosure is shown. After cutting leg assembly 112 is inserted into receptacle 110, at least one wedge 128 is inserted through a back wall 113 of receptacle 110 to engage with a protruding feature 129 on the back of cutter leg 114. Also, taper pins 124 may be inserted in a direction perpendicular to the central reamer axis 101 (FIG. 2) to prevent the cutting leg assembly 112 from moving in an axial direction out of receptacle 110. In particular embodiments, one or more wedges 128 may be mechanically or metallurgically attached to receptacle 110 and/or cutter leg 114 and/or reamer body 106. Still further, in certain embodiments, one or more wedges 128 may be inserted from a side or top of cutter leg assembly 112. In alternate arrangements, taper surface that mates with a taper surface of wedge 128 may be formed in reamer body 106 or receptacle 110. In another alternate arrangement, wedge 128 may have two taper surfaces, one surface that mates with a taper surface in cutter leg 114 and a second surface that mates with a taper surface in reamer body 106 or receptacle 110.

Figure 10:
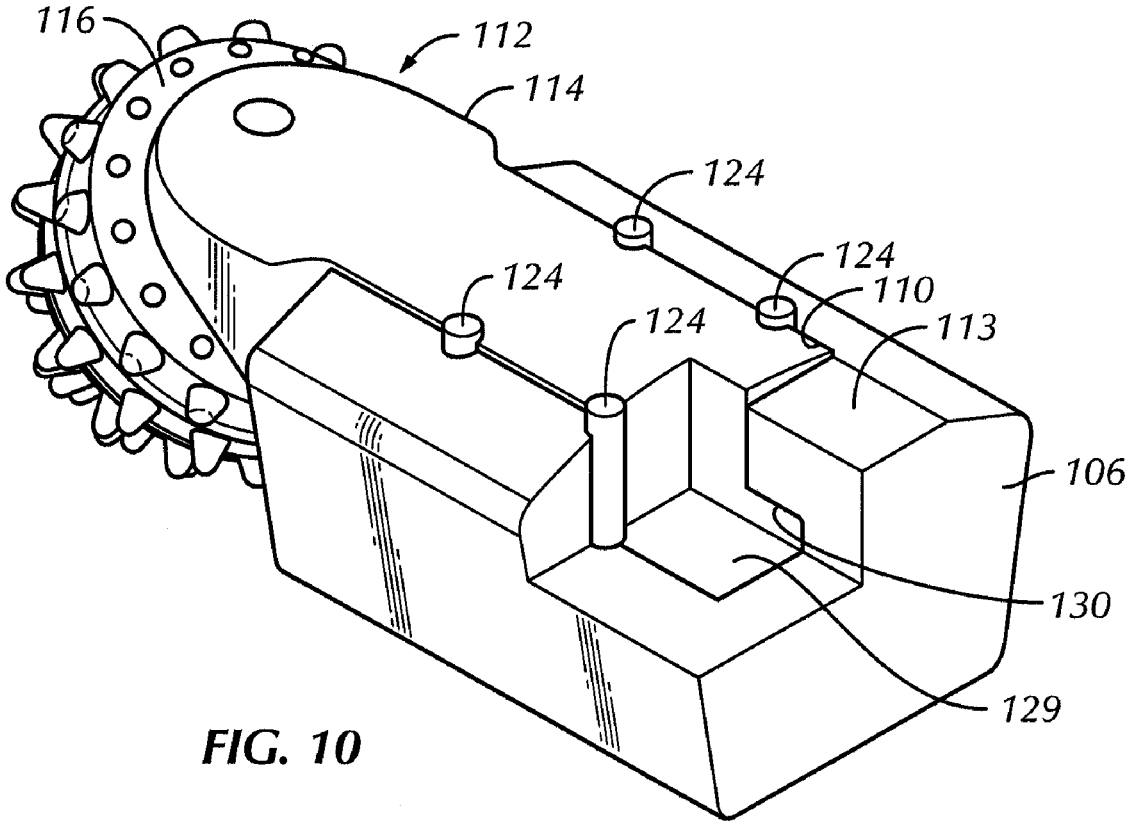
FIG. 10 shows a cut-away perspective view of a cutting leg assembly having a rear protrusion in accordance with embodiments of the present disclosure.

Referring now to FIG. 10, a cut-away perspective view of a cutting leg assembly 112 having a rear protrusion 129 is shown in accordance with embodiments of the present disclosure. To prevent movement of cutting leg assembly 112 in a radial direction, protrusion 129 engages a pocket 130 formed in a back wall 113 of receptacle 110 upon final assembly of cutting leg assembly 112. Cutter leg 114 may then be mechanically or metallurgically attached to receptacle 110. Also, taper pins 124 may be inserted in a direction perpendicular to the central reamer axis 101 (FIG. 2) to prevent the cutting leg assembly 112 from moving in an axial direction out of receptacle 110. Pocket 130 may be machined or otherwise formed integrally within receptacle 110. Additionally, protrusion 129 may be formed integrally with cutter body 114, or in other aspects may be attached mechanically or metallurgically. In alternate arrangements, a separate piece (not shown) may be mechanically or metallurgically attached to receptacle 110 to form pocket 130.

Figure 11A:
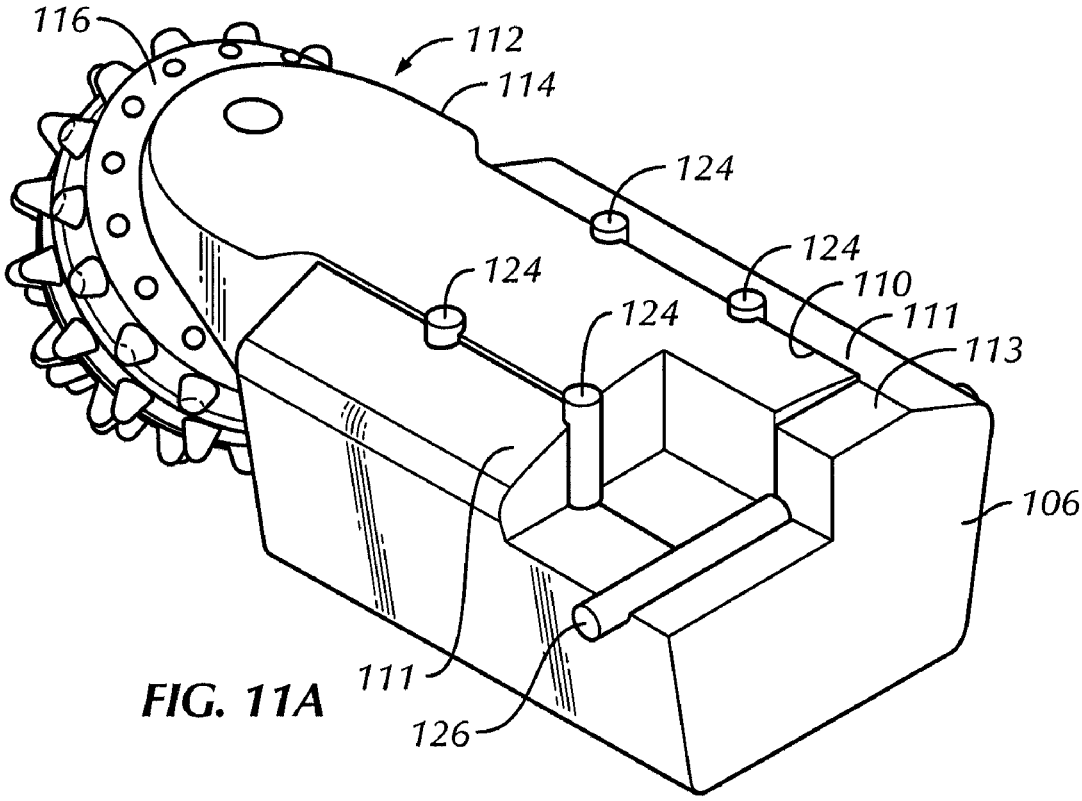
FIGS. 11A and 11B show cut-away perspective and side views, respectively, of a cutting leg assembly having a cross pin in accordance with embodiments of the present disclosure.
Figure 11B:
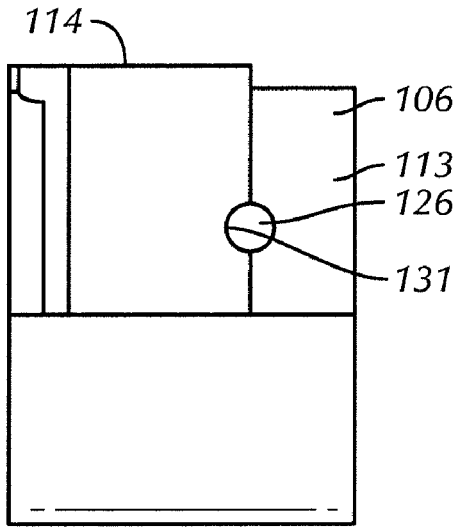

Referring now to FIGS. 11A and 11B, cut-away perspective and side views, respectively, of a cutting leg assembly 112 having a cross pin 126 in accordance with embodiments of the present disclosure are shown. After cutting leg assembly 112 is inserted into receptacle 110, a cross pin 126 is inserted through a side wall 111 of receptacle 110 to engage with a cutout feature 131 (e.g., a hole of matching, or larger, or smaller size to cross pin 126), half of which is formed in a back wall of cutter leg 114 and the other half of which is formed in a back wall 113 of receptacle 110. Also, taper pins 124 may be inserted in a direction perpendicular to the central reamer axis 101 (FIG. 2) to prevent the cutting leg assembly 112 from moving in an axial direction out of receptacle 110. Cross pin 126 may be replaced by other mechanical fasteners, including but not limited to, threaded fasteners, cotter pins, and taper pins. Additionally, cross pin 126 may be mechanically or metallurgically attached to receptacle 110 and/or cutter leg 114 and/or reamer body 106, or cross pin 126 may be made integral with receptacle 110 or cutter leg 114. One or multiple cross pins 126 may be inserted from either or both sides of cutter leg assembly 112. In alternative embodiments, a single cross pin 126 may be inserted through one side wall of receptacle 110, pass through cutter leg 114, and emerge out from a second side of receptacle 110. In other embodiments, a single cross pin 126 may pass through one side wall of receptacle 110, pass through cutter leg 114, and engage a feature on a second side of receptacle 110 (e.g., hole, T-lip). Alternatively ends of cross pin 126 may be captured inside a blind hole in one or both internal side walls of receptacle 110.

Figure 12A:
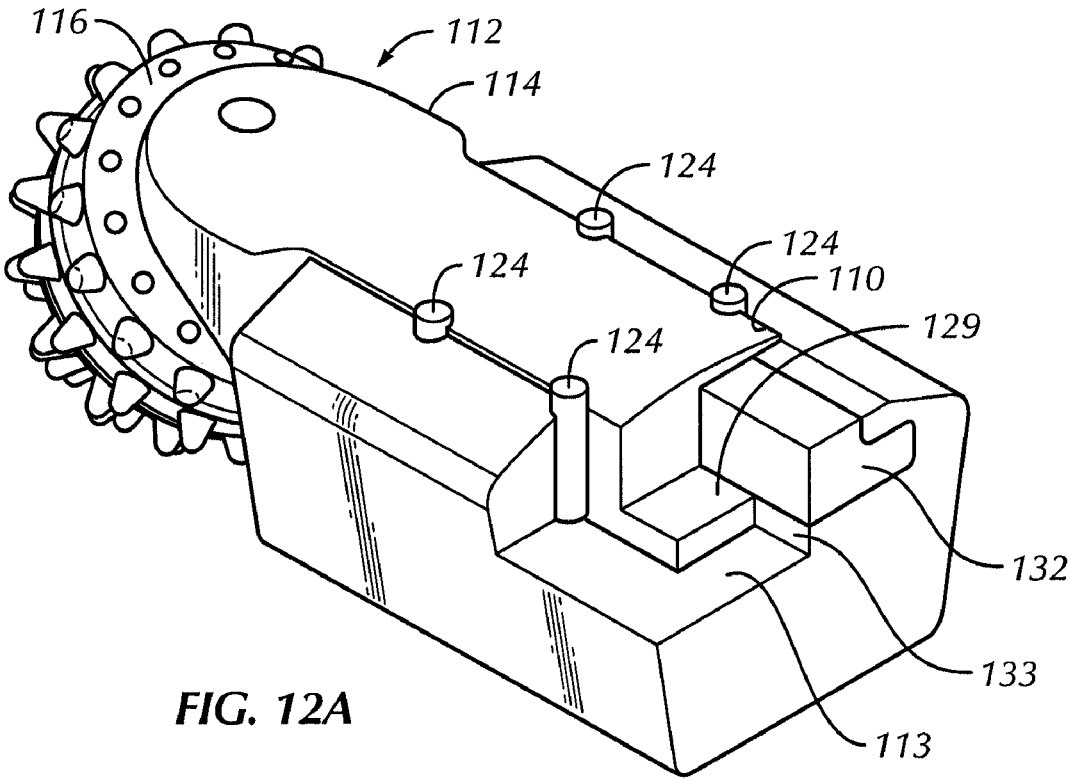
FIGS. 12A and 12B show cut-away perspective and end views, respectively, of a cutting leg assembly having a retention block in accordance with embodiments of the present disclosure.
Figure 12B:
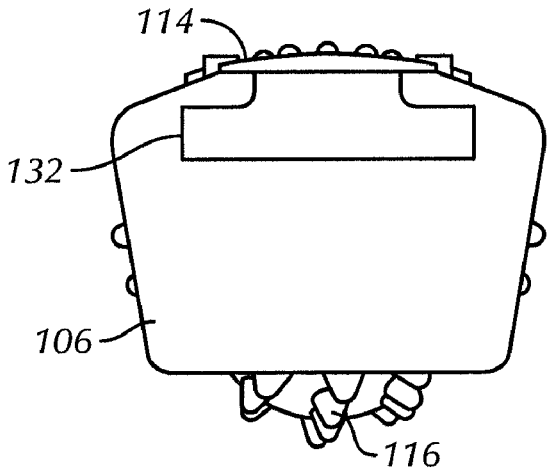

Referring now to FIGS. 12A and 12B, cut-away perspective and end views, respectively, of a cutting leg assembly 112 having a retention block 132 in accordance with embodiments of the present disclosure are shown. After cutting leg assembly 112 is inserted into receptacle 110, a retention block 132 is inserted through a slot 133 in a back wall 113 of receptacle 110 to engage partially with a protruding feature 129 on back of cutter leg 114 and partially with slot 133 in back wall 113 of receptacle 110. Also, taper pins 124 may be inserted in a direction perpendicular to the central reamer axis 101 (FIG. 2) to prevent the cutting leg assembly 112 from moving in an axial direction out of receptacle 110. Retention block 132 may be mechanically or metallurgically attached to receptacle 110, and/or cutter leg 114, and/or reamer body 106. Alternatively, retention block 132 may be integrally formed with receptacle 110 or cutter leg 114. Still further, in alternative embodiments, retention block 129 may be inserted from a side or top of cutter leg assembly 112.

Figure 13A:
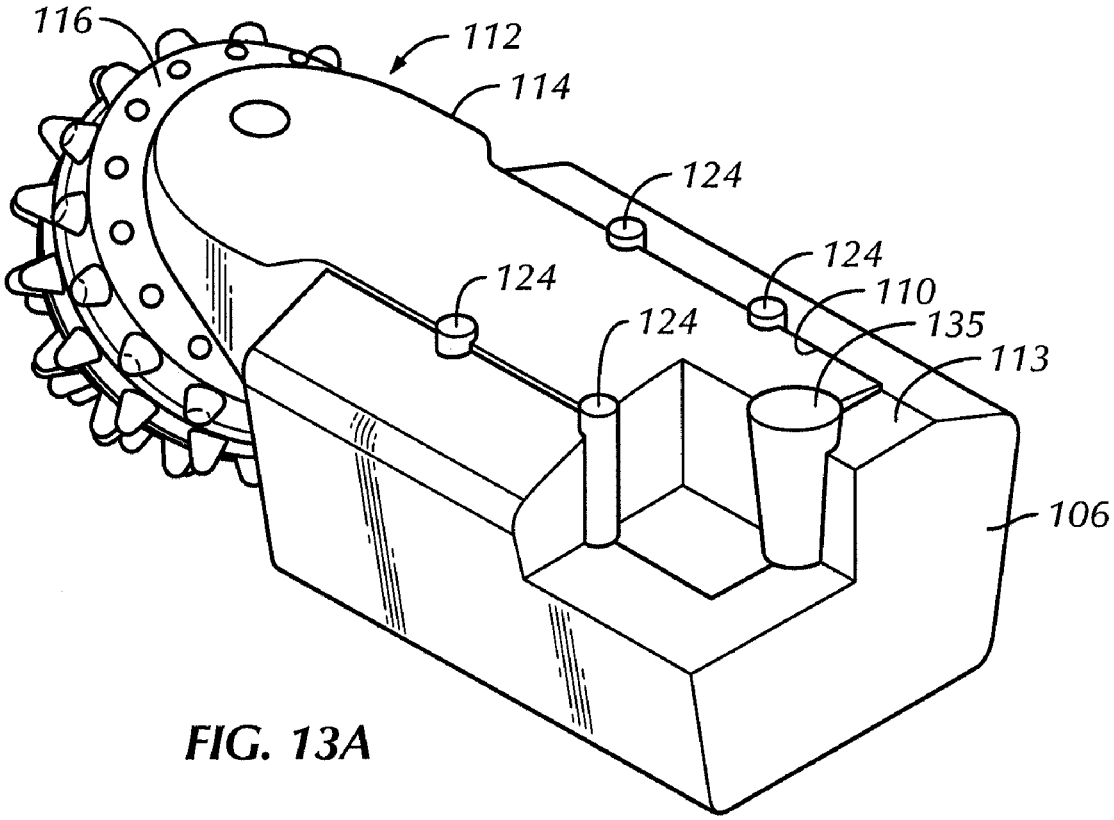
FIGS. 13A and 13B show cut-away perspective and side views, respectively, of a cutting leg assembly having a taper pin in accordance with embodiments of the present disclosure.
Figure 13B:
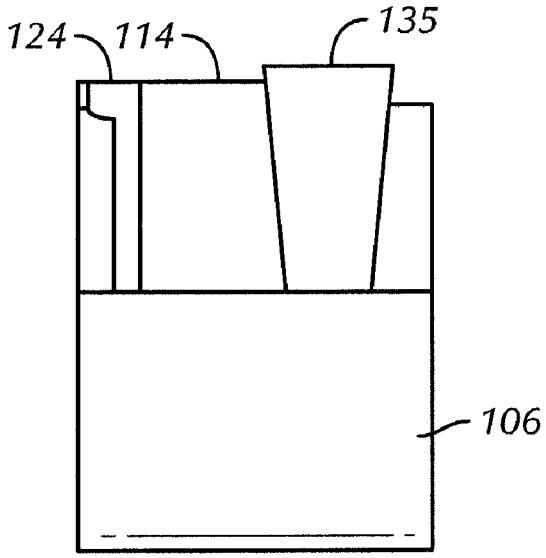

Referring now to FIGS. 13A and 13B, a cut-away perspective and a cross-sectional view, respectively, of a cutting leg assembly 112 having a taper pin 135 in accordance with embodiments of the present disclosure are shown. After cutting leg assembly 112 is inserted (in a direction perpendicular to the central reamer axis 101 (FIG. 2)) into receptacle 110, a taper pin 135 is inserted into a corresponding taper hole, half of which is formed in a back wall of cutter leg 114 and the other half of which is formed in a back wall 113 of receptacle 110. Also, taper pins 124 may be inserted in a direction perpendicular to the central reamer axis 101 (FIG. 2) to prevent the cutting leg assembly 112 from moving in an axial direction out of receptacle 110. Taper pin 135 may be mechanically or metallurgically attached to receptacle and/or cutter leg 114. Alternatively, taper pin 135 may be replaced by other mechanical fasteners, including, but not limited to, threaded fasteners, cotter pins. Still further, taper pins may be inserted from either or both sides in a radial direction.

Advantageously, embodiments of the present disclosure may provide a back reamer having retention mechanisms configured to retain cutting leg assemblies in their respective receptacles to minimize movement of the cutting leg assembly within the receptacle. By minimizing the movement of the cutting leg assemblies, weld cracking may be reduced or even eliminated. Furthermore, the retention mechanisms, by using an arrangement of mechanical fasteners, may prevent dislodging of the cutting leg assembly inside the borehole if a weld fails. Thus, embodiments disclosed herein may reduce maintenance costs associated with repairing dislodged cutting leg assemblies and cracked welds, as well as reduce or eliminate expensive "fishing" operations to retrieve a lost cutting leg assembly.

While the present disclosure has been described with respect to a limited number of embodiments, those skilled in the art, having benefit of this disclosure, will appreciate that other embodiments may be devised which do not depart from the scope of the disclosure as described herein. Accordingly, the scope of the disclosure should be limited only by the attached claims.

What is claimed is:

1. A back reamer comprising:

a drive stem configured to support a main reamer body, the main reamer body comprising a plurality of receptacles; and a plurality of cutting leg assemblies in positive locking engagement with the plurality of receptacles to restrict radial movement of the cutting leg assemblies, wherein at least one positive locking engagement comprises a retention mechanism disposed between a corresponding cutout partially formed in a back wall of the cutting leg assembly and partially formed in a back wall of the receptacle.

2. The back reamer of claim 1, further comprising a plurality of shims engaged within the plurality of receptacles to position the cutting leg assemblies at a specified height.

3. The back reamer of claim 1, wherein at least one positive locking engagement between the plurality of receptacles and the plurality of cutting leg assemblies comprises a protruding lip along a length of the cutting leg assembly configured to engage a corresponding cutout in the receptacle.

4. The back reamer of claim 1, wherein at least one positive locking engagement between the plurality of receptacles and the plurality of cutting leg assemblies comprises at least one side pin configured to engage a corresponding feature of the cutting leg assembly.

5. The back reamer of claim 1, wherein at least one positive locking engagement between the plurality of receptacles and the plurality of cutting leg assemblies comprises at least one back pin configured to engage a corresponding feature of the cutting leg assembly.

6. The back reamer of claim 1, wherein at least one positive locking engagement between the plurality of receptacles and the plurality of cutting leg assemblies comprises at least one back wedge configured to engage a corresponding feature of the cutting leg assembly.

7. The back reamer of claim 1, wherein the retention mechanism comprises a cross pin configured to engage the corresponding cutout.

8. The back reamer of claim 1, wherein the retention mechanism comprises a retention block configured to engage a corresponding feature of the cutting leg assembly and a slot formed in a back wall of the receptacle.

9. The back reamer of claim 1, wherein the retention mechanism comprises a taper pin configured to engage the corresponding cutout.

10. The back reamer of claim 1, wherein the drive stem and reamer body are constructed as single component.

11. The back reamer of claim 1, wherein the cutting leg assembly is secured to the main reamer body with at least one taper pin inserted in a direction perpendicular to a central axis of the main reamer body.

12. A method of securing cutting leg assemblies to a main reamer body of a back reamer, the method comprising:

inserting the cutting leg assembly into a corresponding receptacle formed in the main reamer body;

positively locking the cutting leg assembly and the corresponding receptacle to restrict radial movement of the cutting leg assembly;

welding the cutting leg assembly to the corresponding receptacle; and engaging a taper pin with a corresponding tapered cutout, wherein the corresponding tapered cutout is partially formed in a back wall of the receptacle and partially formed in a back wall of the cutting leg assembly.

13. The method of claim 12, further comprising engaging a protruding lip along a length of the cutting leg assembly with a corresponding cutout in the receptacle.

14. The method of claim 12, further comprising engaging at least one side pin with a corresponding feature of the cutting leg assembly.

15. The method of claim 12, further comprising engaging at least one back pin with a corresponding feature of the cutting leg assembly.

16. The method of claim 12, further comprising engaging at least one back wedge with a corresponding feature of the cutting leg assembly.

17. The method of claim 12, further comprising engaging a rear protrusion of the cutting leg assembly with a pocket formed in a back wall of the receptacle.

18. The method of claim 12, further comprising engaging a cross pin with a corresponding cutout, wherein the corresponding cutout is partially formed in a back wall of the cutting leg assembly and partially formed in a back wall of the receptacle.

19. The method of claim 12, further comprising engaging a retention block with a corresponding feature of the cutting leg assembly and a slot formed in a back wall of the receptacle.

20. The method of claim 12, further comprising engaging a plurality of shims within the plurality of receptacles to position the cutting leg assemblies at a specified height.

21. The method of claim 12, wherein the drive stem and reamer body are constructed as single component.

22. A back reamer comprising:

a drive stem configured to support a main reamer body, the main reamer body comprising a plurality of receptacles;

a plurality of cutting leg assemblies in positive locking engagement with the plurality of receptacles to restrict axial movement of the cutting leg assemblies; and a rear protrusion of at least one cutting leg assembly configured to engage a pocket formed in a back wall of the corresponding receptacle;

wherein the cutting leg assemblies and the plurality of receptacles are welded along a substantial length of an externally accessible interface between the cutting leg assemblies and the plurality of receptacles.

23. The back reamer of claim 22, further comprising a plurality of shims engaged within the plurality of receptacles to position the cutting leg assemblies at a specified height.

24. The back reamer of claim 22, further comprising cutter bodies rotatably connected to the cutting leg assemblies.

25. The back reamer of claim 22, wherein the cutter bodies comprise cutting elements selected from a group consisting of tungsten carbide insert cutting elements and hardmetal coated milled tooth cutting elements.

26. The back reamer of claim 22, wherein the cutting leg assemblies comprise drag type cutting elements.

27. The back reamer of claim 26, wherein the drag type cutting elements are selected from a group consisting of polycrystalline diamond and natural diamond.

28. The back reamer of claim 22, wherein the drive stem and reamer body comprise a single component.

29. A back reamer comprising:

a drive stem configured to support a main reamer body, the main reamer body comprising a plurality of receptacles; and a plurality of cutting leg assemblies in positive locking engagement with the plurality of receptacles to restrict radial movement of the cutting leg assemblies, wherein at least one positive locking engagement comprises a cross pin extending through a side wall of the receptacle and into the cutting leg assembly.

* * * * *

Disclaimer

8,302,709 B2 — Amol Bhome, Spring, TX (US); and Robert H. Slaughter, Jr., Spring, TX (US) DOWNHOLE TOOL LEG RETENTION METHODS AND APPARATUS. Patented date November 6, 2012. Disclaimer filed July 2, 2012 by the Assignee, Sandvik Intellectual Property, AB.

The term of this patent shall not extend beyond the expiration date of Patent No. 8,177,000.

*(Official Gazette, March 26, 2013)*